US009620272B2

(12) United States Patent
Nakayama

(10) Patent No.: US 9,620,272 B2
(45) Date of Patent: Apr. 11, 2017

(54) SUPERCONDUCTING MAGNET DEVICE

(71) Applicant: Hitachi, Ltd., Tokyo (JP)

(72) Inventor: Takeshi Nakayama, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 14/618,296

(22) Filed: Feb. 10, 2015

(65) Prior Publication Data

US 2015/0270045 A1 Sep. 24, 2015

(30) Foreign Application Priority Data

Mar. 18, 2014 (JP) ..... 2014-054294

(51) Int. Cl.

| | |
|---|---|
| ***H01F 6/00*** | (2006.01) |
| ***H01F 6/04*** | (2006.01) |
| ***H01F 6/06*** | (2006.01) |
| ***F25D 19/00*** | (2006.01) |

(52) U.S. Cl.

CPC ..... *H01F 6/04* (2013.01); *F25D 19/006* (2013.01); *H01F 6/06* (2013.01)

(58) Field of Classification Search

CPC ..... H01F 6/00–6/04
USPC ..... 335/216
See application file for complete search history.

(56) References Cited

U.S. PATENT DOCUMENTS 5,590,533 A * 1/1997 Asami ..... F17C 3/085 60/520
5,647,218 A * 7/1997 Kuriyama ..... F25B 9/14 62/175
5,686,876 A * 11/1997 Yamamoto ..... H01F 6/065 174/15.4
5,711,157 A * 1/1998 Ohtani ..... F25B 9/10 62/467
6,332,324 B1 * 12/2001 Saho ..... F17C 3/02 62/383
6,334,909 B1 * 1/2002 Okamura ..... C09K 5/14 148/303
6,354,087 B1 * 3/2002 Nakahara ..... F17C 13/02 62/6
6,363,727 B1 * 4/2002 Hashimoto ..... C09K 5/14 62/6
2005/0229609 A1 * 10/2005 Kirichek ..... F25B 9/02 62/6
2006/0048522 A1 * 3/2006 Yamada ..... F25B 25/005 62/6

(Continued)

FOREIGN PATENT DOCUMENTS

JP 07-142235 6/1995
JP 08-138928 5/1996

(Continued)

*Primary Examiner* — Shawki S Ismail
*Assistant Examiner* — Lisa Homza
(74) *Attorney, Agent, or Firm* — Mattingly & Malur, PC

(57) ABSTRACT

A permanent current switch device of a refrigerator cooling-type superconducting magnet includes a superconducting coil cooled by solid thermal conduction and a permanent current switch. A heat transfer member is thermally connected to a cooling stage and is structured to be inserted into and removable from a former of the permanent current switch. Due to differences in thermal expansion between the heat transfer member and the former, a permanent current mode can be stably maintained.

5 Claims, 5 Drawing Sheets

(56) References Cited

U.S. PATENT DOCUMENTS

2006/0086101 A1* 4/2006 Miki ..... F17C 1/00 62/48.2
2007/0186560 A1* 8/2007 Schauwecker ..... F25B 21/00 62/3.1
2008/0115520 A1* 5/2008 Strobel ..... F25B 9/145 62/303
2008/0191697 A1* 8/2008 Chiba ..... G01R 33/3804 324/318
2009/0188260 A1* 7/2009 Saho ..... F25B 9/14 62/3.6
2009/0193816 A1* 8/2009 Clayton ..... F25D 19/00 62/47.1
2009/0212890 A1* 8/2009 Saho ..... H01F 6/04 335/216
2012/0157320 A1* 6/2012 Yamada ..... C09K 5/08 505/162
2013/0000326 A1* 1/2013 Xu ..... F25B 9/10 62/6
2014/0374054 A1* 12/2014 Xu ..... F28D 17/02 165/10
2015/0051079 A1* 2/2015 Takahashi ..... H01F 6/04 505/163
2015/0075188 A1* 3/2015 Xu ..... F25B 9/10 62/6
2015/0108980 A1* 4/2015 Buehler ..... F25B 9/145 324/318
2015/0253042 A1* 9/2015 Matsui ..... F25B 9/145 62/6
2016/0061382 A1* 3/2016 Simpkins ..... F25D 19/006 62/51.1
2016/0097567 A1* 4/2016 Hiratsuka ..... F25B 9/14 62/6

FOREIGN PATENT DOCUMENTS

JP 10-107333 4/1998
JP 10-247753 9/1998

* cited by examiner

SUPERCONDUCTING MAGNET DEVICE

BACKGROUND OF THE INVENTION

1. Field of the Invention

The present invention relates to a superconducting magnet device and particularly to a superconducting magnet employing a refrigerator cooling system.

2. Description of the Related Art

Japanese Patent No. 3,117,173 is a background art in this technical field. This literature discloses a technique in which a permanent current switch is arranged on a cooling stage on a high temperature side thermally connected to a refrigerator, whereas a superconducting coil is arranged on a cooling stage thermally connected to a low temperature side of the refrigerator, so as to enable collection of generated heat when the permanent current switch is off.

JP-A-10-247753 is another background art. This literature discloses "comprising a unit to which superconductive device is thermally connected, a separation/connection unit thermally connected to this cooling unit, and a permanent current switch thermally connected to a part that is not connected to the cooling unit, of the separation/connection unit".

Japanese Patent No. 3,020,140 is still another background art. This literature discloses "a structure comprising a heat transfer rod thermally connected to a permanent current switch, a drive unit which mechanically moves the heat transfer rod, a two-stage refrigerator, and cooling stages connected to a high temperature side and a low temperature side of the refrigerator, wherein the drive unit is controlled to thermally connect the heat transfer rod to the cooling stage on the high temperature side or the cooling stage on the low temperature side".

JP-A-8-138928 is still another background art. This literature discloses a unit which mechanically disconnects thermal connection between a permanent current switch and a refrigerator, as in JP-A-10-247753.

In the methods for mechanically switching the heat transfer path to the permanent current switch, disclosed in Japanese Patent No. 3,117,173, JP-A-10-247753, Japanese Patent No. 3,020,140, and JP-A-8-138928, the heat transfer rod is made to contact the cooling stage simply by the force of the drive unit. These methods have a problem that an excessive load acts on a support rod which supports the cooling stage from the normal temperature side. There are conflicting problems that while it is difficult to thicken this support rod in view of the amount of heat penetration, a predetermined contact pressure or above is necessary in order to connect the heat transfer rod to the cooling stage. If a sufficient contact pressure cannot be achieved, refrigeration capability needs to be increased excessively, contributing to a rise in cost.

SUMMARY OF THE INVENTION

In view of the foregoing problems, an object of the invention is to provide a permanent current switch device of a refrigerator cooling-type superconducting magnet so that a permanent current mode can be realized efficiently.

To solve the foregoing problems, according to an aspect of the invention, a permanent current switch device of a refrigerator cooling-type superconducting magnet includes: a superconducting coil cooled by solid thermal conduction; and a permanent current switch. A part of a structure thermally connected to a refrigerator is structured in such a way that this part can be inserted into an axis part of a former of the permanent current switch.

According to another aspect of the invention, a refrigerator cooling-type superconducting magnet device includes: a superconducting coil cooled by solid thermal conduction; a permanent current switch; and a cooling stage connected to a refrigerator. The superconducting coil, the permanent current switch, and the cooling stage are contained in a vacuum container. A structure thermally connected to the permanent current switch is in the form of a threaded bolt. A nut is arranged on the bolt-shaped structure. The cooling stage is arranged between the nut and a head of the bolt. The bolt-shaped structure is structured to be rotatable from an atmospheric side of the vacuum container.

Using the permanent current switch device of the refrigerator cooling-type superconducting magnet device enables reduction in thermal resistance between the cooling stage and the permanent current switch device. Therefore, the permanent current switch can be cooled more efficiently.

DETAILED DESCRIPTION OF THE PREFERRED EMBODIMENTS

Hereinafter, examples will be described with reference to the drawings.

Example 1

Figure 1:
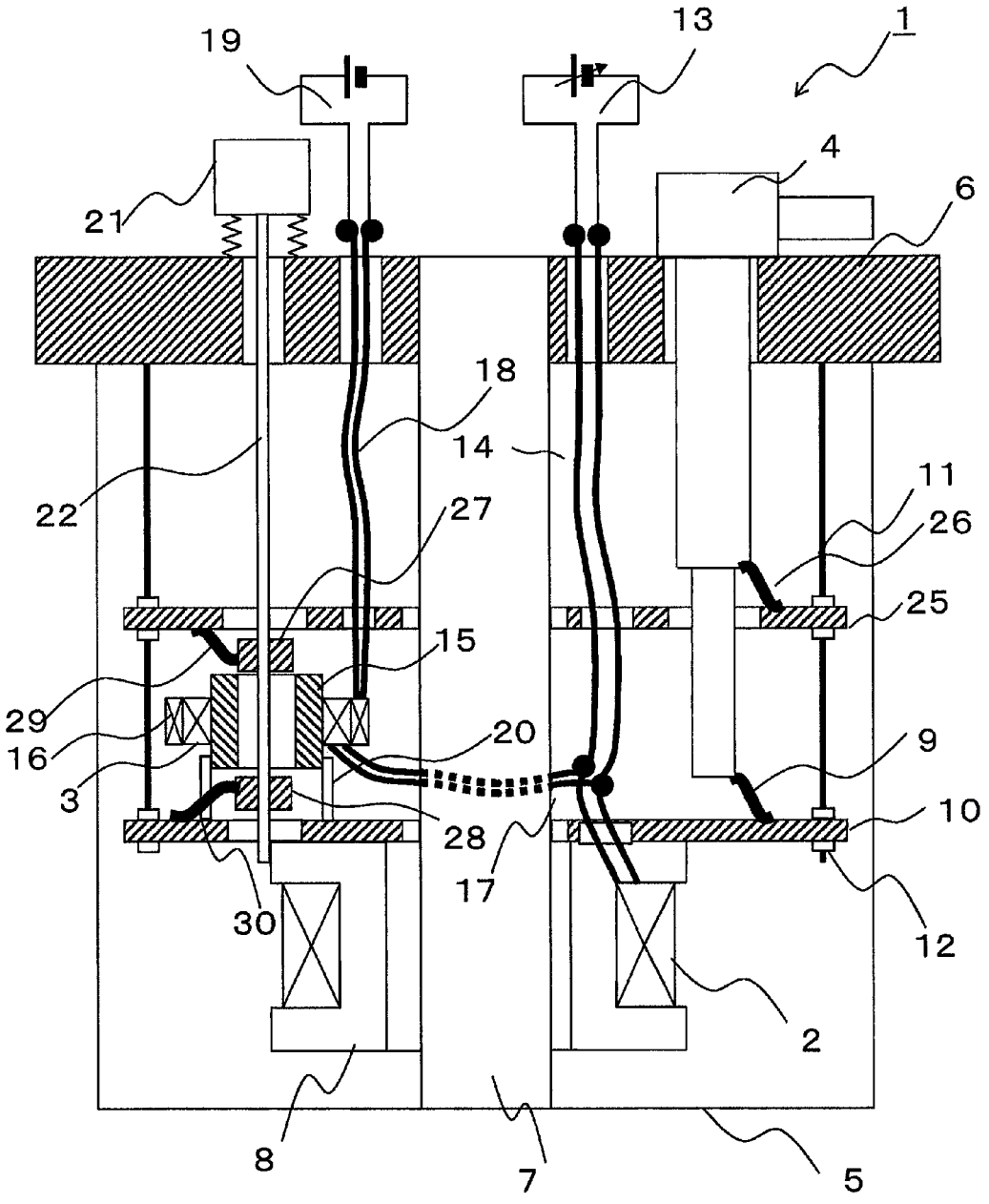
FIG. 1 shows a superconducting magnet device according to a first example.

FIG. 1 is a cross-sectional view of a refrigerator cooling-type superconducting magnet device according to a first example of the invention.

A superconducting magnet device 1 mainly includes a superconducting coil 2, a permanent current switch 3, a refrigerator 4 which cools the superconducting coil 2 and the permanent current switch 3, and a vacuum container 5 which contains the superconducting coil 2 and the permanent current switch 3. The inside of the vacuum container 5 is kept in high vacuum for thermal insulation, and a vacuum container lid 6 is arranged on the top of the vacuum container 5. A test space 7 is prepared in order to use a magnetic field generated by the superconducting magnet device 1. The superconducting coil 2 is wound on a bobbin 8. The bobbin 8 is thermally connected to low temperature-side cooling stage 10 (hereinafter, cooling stage 10) of the refrigerator 4 via a highly elastic good conductor 9.

In order to reduce the amount of heat penetration from outside as much as possible, the cooling stage 10 is supported from the vacuum container lid 6 by a support rod 11 made from FRP or the like with a low thermal conductivity. In this case, the cooling stage 10 is fixed to the support rod 11 with a bolt 12 arranged to sandwich the cooling stage 10 vertically. A current to the superconducting coil 2 is supplied from a DC power source 13 via a superconducting wire 14

(power lead). The superconducting wire 14 may be thermally connected to the refrigerator 4 according to need, in order to maintain a superconducting state.

The permanent current switch 3 is configured in the form of a superconducting wire wound on a former 15. A heater 16 that is necessary to turn off the permanent current switch is wound on the outside of the permanent current switch 3. The heater 16 may be arranged on the former 15 side of the permanent current switch 3. In any case, the heater 16 has the function of heating the permanent current switch 3.

A superconducting wire 17 connected to the permanent current switch 3 is electrically connected to the superconducting wire 14, in such a way that the superconducting coil 2 and the permanent current switch 3 are connected in parallel to each other, as viewed from the DC power source 13. The heater 16 is connected to a power source 19 with a sufficient capacity, via a normal conducting wire 18, and the current thereto is on/off-controlled by a controller, not shown. The former 15 of the permanent current switch 3 is supported from the cooling stage 10 by a thermal insulation support 20 of FRP or the like with a low thermal conductivity.

Figure 4:
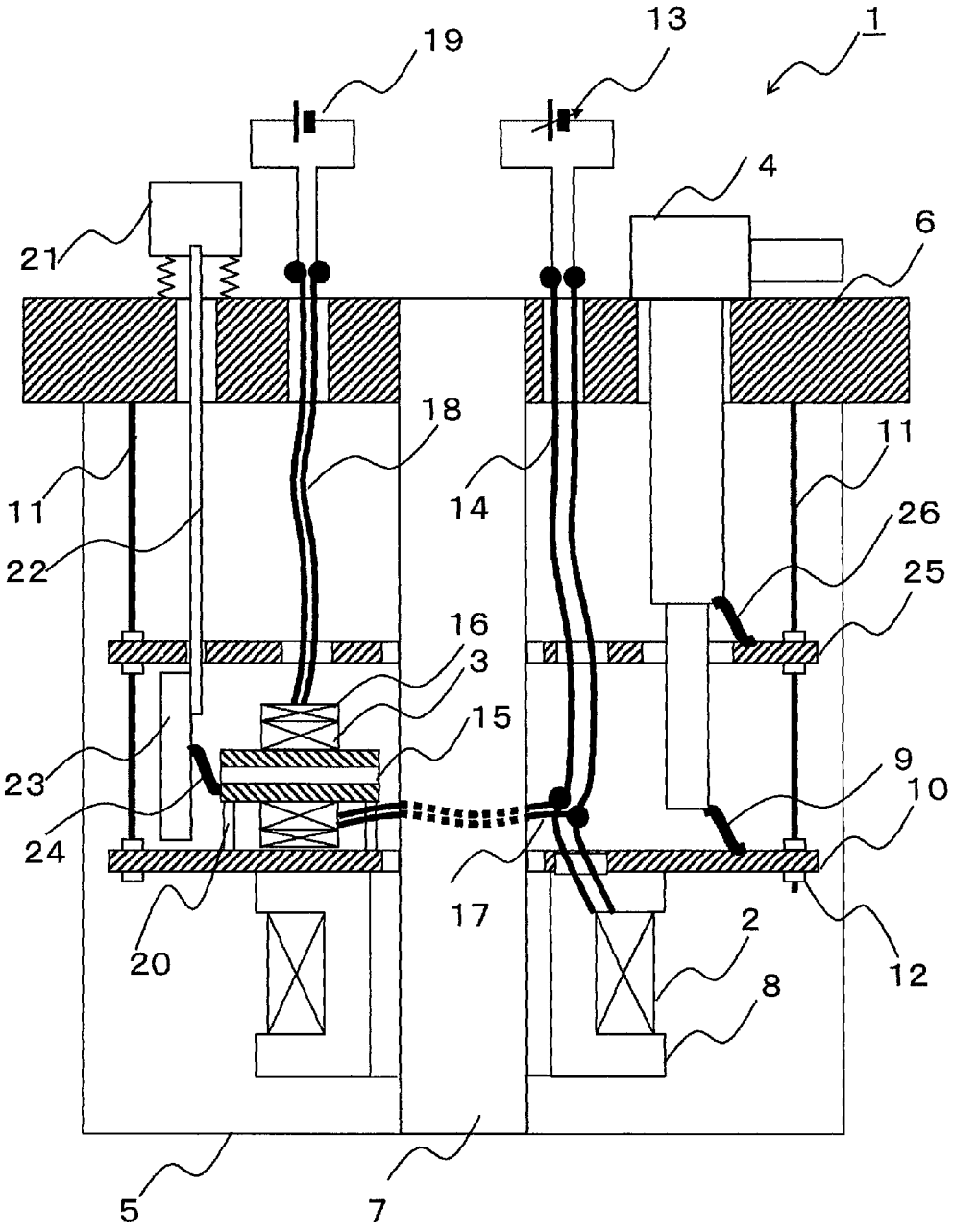
FIG. 4 shows a superconducting magnet device according to a comparative example.

Before explaining the cooling structure of the permanent current switch 3 in this example, a comparative example will be described. FIG. 4 is a cross-sectional view of a superconducting magnet device according to a comparative example.

In the comparative example, the former 15 is thermally connected to a heat transfer rod 23 that can be moved up and down by a drive unit 21 via a drive support rod 22, and to a highly elastic good conductor 24. Under the control of the drive unit 21, the heat transfer rod 23 can contact the cooling stage 10 or a high temperature-side cooling stage 25 (hereinafter, cooling stage 25). The cooling stage 25 thermally connected to a highly elastic good conductor 26 and the high temperature side of the refrigerator 4.

Figure 5:
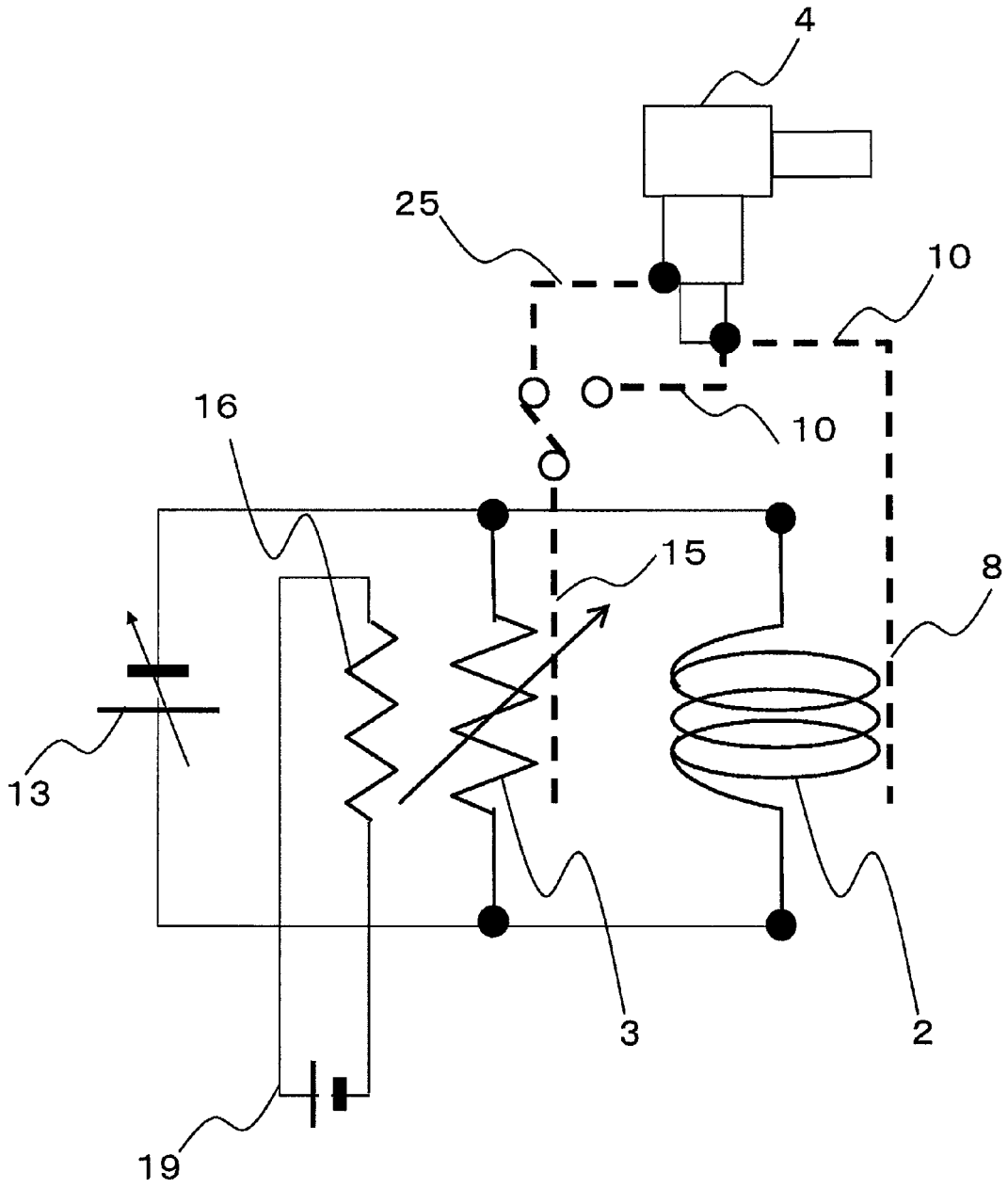
FIG. 5 shows an electrical circuit and a thermal circuit of the superconducting magnet device according to the comparative example.

FIG. 5 shows an equivalent circuit of the electrical circuit and the thermal circuit shown in FIG. 4. The reference numbers in FIG. 5 are the same as described with reference to FIG. 4 and therefore will not be described further. Using FIG. 5, startup of the superconducting coil current and shift to a permanent current mode will be described.

First, when injecting a current to the superconducting coil 2, the permanent current switch 3 needs to be in a normal conducting state. Therefore, a current is supplied to electrify the heater 16 of the permanent current switch 3 by the power source 19, and the permanent current switch is thus heated. At the same time, in order to collect the generated heat at the cooling stage 25, the drive unit 21 is controlled to connect the heat transfer rod 23 to the cooling stage 25 (the circuit state of FIG. 5).

At this point, the electrification of the heater 16 is not necessary if the critical temperature of the superconducting wire material used for the permanent current switch 3 is set below the temperature of the cooling stage 25 of the refrigerator 4. Then, the DC power source 13 is controlled to increase the current until a predetermined current flows through the permanent current switch 3. As the current reaches a predetermined value, the electrification of the heater 16 is stopped and the drive unit 21 is controlled to connect the heat transfer rod 23 to the cooling stage 10, thus cooling the permanent current switch 3, in order to shift the permanent current switch 3 to a superconducting state. When the permanent current switch 3 is cooled sufficiently, the voltage of the DC power source 13 is lowered, thus shifting to a permanent current mode.

Meanwhile, the former 15 of the permanent current switch in the present example is supported form the low temperature-side cooling stage 10, using the thermal insulation support 20. However, in this example, unlike the comparative example of FIG. 4, the permanent current switch 3 is arranged in such a way that the axis of the former 15 thereof is parallel to the vertical direction. The former 15 is a hollow tubular member and may have not only a circular cross sectional but also various cross-sectional shapes. The inner-diameter cross section of the former 15 mentioned below refers to a cross section of the hollow part in the tube in the case where the former 15 is sliced on a plane perpendicular to the vertical direction.

On the drive unit support 22, a high temperature-side heat transfer member 27 (first heat transfer member) and a low temperature-side heat transfer member 28 (second heat transfer member) are fixed. The high temperature-side heat transfer member 27 (hereinafter, heat transfer member 27) is thermally connected to the cooling stage 25 via a highly elastic good conductor 29. The low temperature-side heat transfer member (hereinafter, heat transfer member 28) is thermally connected to the cooling stage 10 via a highly elastic good conductor 30. The heat transfer members 27 and 28 are shaped in such a way that these members can be inserted in the hollow part of the former 15.

Here, as the material of the heat transfer members 27 and 28, a material with a smaller coefficient of thermal expansion than the material of the former 15 of the permanent current switch 3 is chosen. For example, it is preferable to use copper for the heat transfer members 27 and 28, and aluminum or the like for the former 15. As the critical temperature of the superconducting wire used for the permanent current switch 3, a lower temperature than the temperature of the high temperature-side cooling stage is employed.

Next, the operation at the time of starting up the current in the superconducting coil 2 in this example will be described. First, at the time of starting up the current in the superconducting coil 2, the heater 16 of the permanent current switch 3 is electrified to thermally expand the former 15 of the permanent current switch 3, as explained with reference to FIG. 5. The permanent current switch 3 may be heated by the heater 16 at this point, since the permanent current switch 3 may be in the normal conducting state under the circumstance where the superconducting magnet device 1 is not operating in the permanent current mode.

Subsequently, the drive unit 21 is controlled to lower the drive unit support 22 and thus move the heat transfer member 27 so that the heat transfer member 27 is situated inside the former 15. Then, the electrification of the heater 16 is stopped. Thus, the former 15 is cooled by heat radiation and therefore deforms by thermal contraction to tightly bind the heat transfer member 27 in the state of being placed in the center, and thus tightly contacts the heat transfer member 27. This deformation of the former 15 secures a contact pressure between the heat transfer member 27 and the former 15. The permanent current switch 3 reaches the same temperature as the cooling stage 25 and exceeds the critical temperature and therefore enters into the normal conducting state.

Next, at the time of shifting to the permanent current mode, the heater 16 is electrified. This causes the former 15 with a greater coefficient of thermal expansion than the heat transfer member 27 to expand more, and therefore enables the heat transfer member 27 to operate up and down. After the heat transfer member 27 becomes operable, the drive unit 21 is controlled to lift the drive unit support 22 and thus move the heat transfer member 28 so that the heat transfer member is situated inside the former 15. After that, the electrification of the heater 16 is stopped. This causes the former 15 to tightly bind the heat transfer member 28 in the state of being placed in the center, by thermal contraction via heat radiation. Therefore, a predetermined contact pressure is secured at the contact surface between the heat transfer member 28 and the former 15, and the permanent current switch 3 is cooled efficiently. Thus, the permanent current mode can be maintained stably.

In view of securing a contact pressure between the heat transfer members 27 and 28 and the former 15, it is desirable that a cross-sectional shape formed by slicing the heat transfer members 27 and 28 on a plane perpendicular to the vertical direction is a similar figure to the inner-diameter cross section of the former 15 and is equal to or smaller than the inner-diameter cross section of the former 15 when thermally expanding and greater than the inner-diameter cross section of the former 15 when thermally contracting. This is because, by having a larger cross section than the cross-sectional shape of the former 15 when thermally contracting, a higher contact pressure can be expected when the heat transfer members are tightly bound.

As a matter of course, the cross-sectional shape of the heat transfer members 27 and 28 is not limited to a similar figure to the inner-diameter cross section of the former 15, and the cross-sectional shape of the heat transfer members 27 and 28 and the shape of the inner-diameter cross section of the former 15 can be freely chosen within a range where a predetermined contact pressure can be secured by thermal contraction.

Also, if the superconducting wire 17 of the permanent current switch 3 has a sufficient length, another embodiment that can achieve similar effects to the above example can be formed by a structure that holds the low temperature-side heat transfer member 28 in the state of being situated inside the former 15 without using the drive unit 21. That is, if the former 15 is separated from the low temperature-side heat transfer member 28 by the heater 16, the superconducting wire 17 is the only cooling path of the permanent current switch 3. If the superconducting wire 17 has a sufficient length, it is equivalent to securing thermal resistance. Therefore, the permanent current switch 3 can be maintained in the normal conducting state by the heater 16.

Thus, as the superconducting wire 17 has a sufficient length, there is no need to provide the drive unit 21 and the drive support rod 22 and there is no heat input via these members, either. This forms an example in which the permanent current mode with higher stability can be maintained.

Example 2

Figure 2:
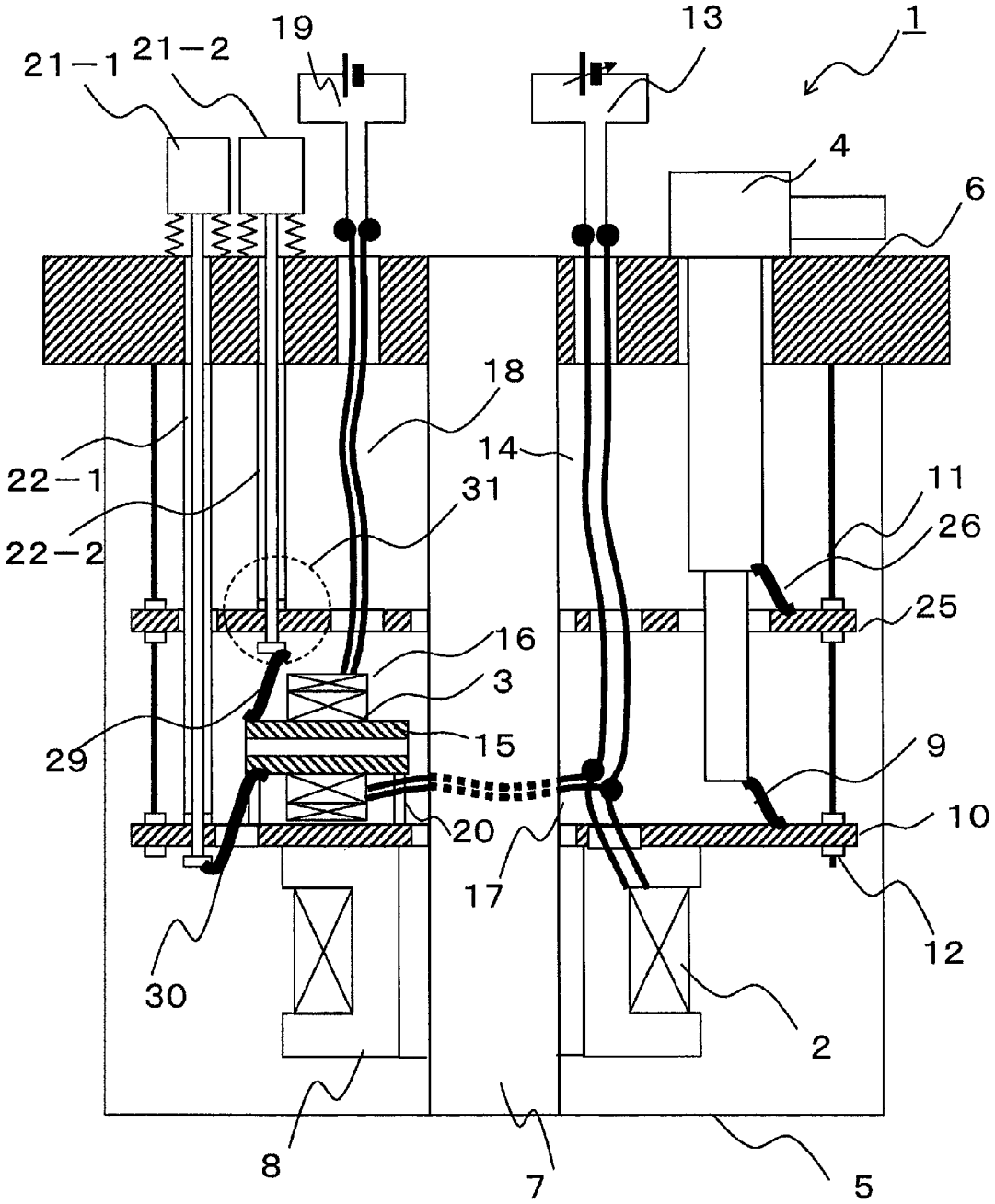
FIG. 2 shows a superconducting magnet device according to a second example.

A second example of the invention will be described with reference to FIG. 2. The configurations of the permanent current switch 3 and its former 15 and heater 16 are the same as in FIG. 1. The difference is that drive units 21-1 and 21-2 are installed for the high temperature-side and low temperature-side heat transfer members, respectively. Also, supports 22-1 and 22-2 are installed for the heat transfer members, respectively. Each of the supports 22-1 and 22-2 has a double structure, as described below.

Figure 3:
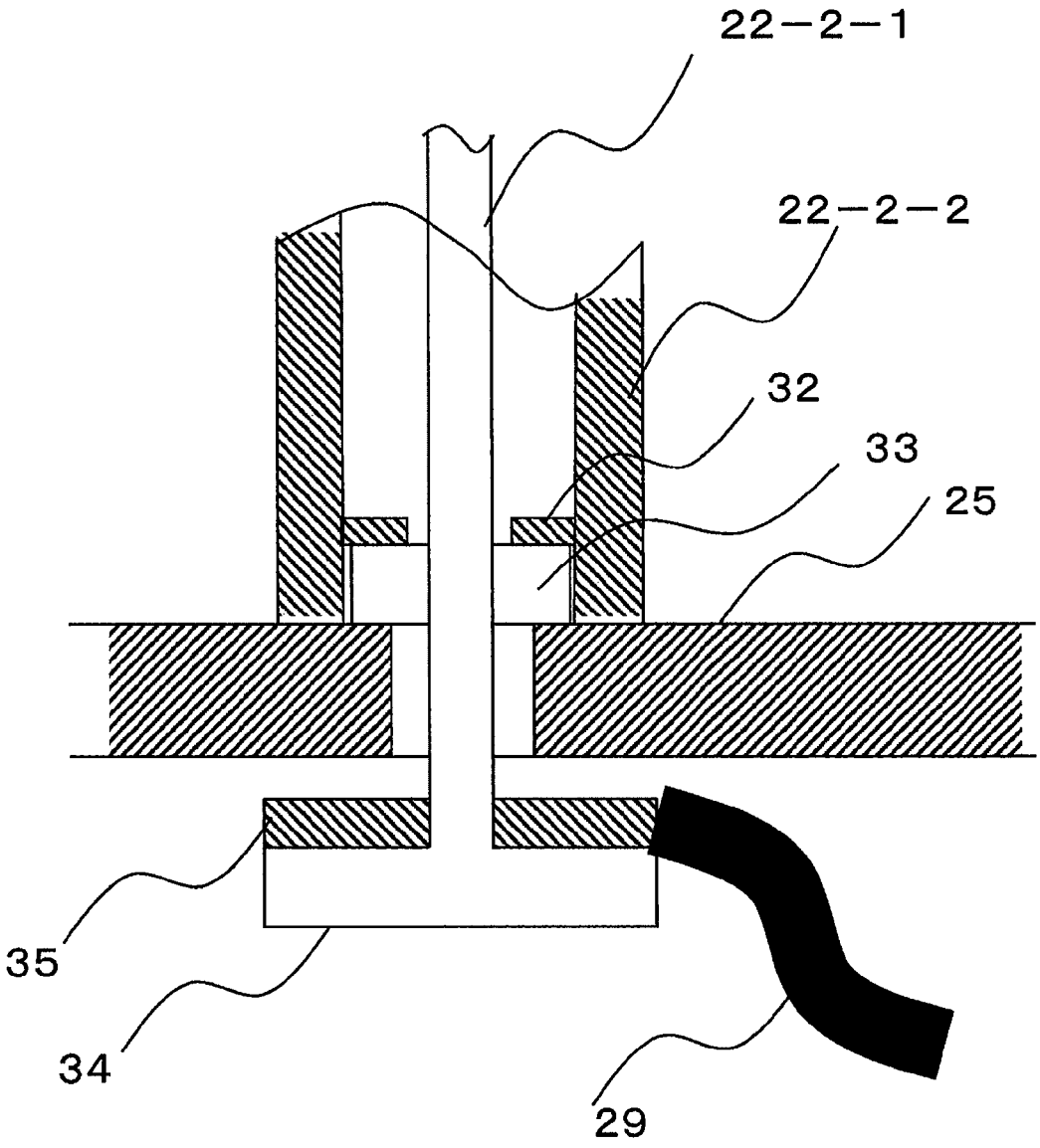
FIG. 3 is an enlarged view showing a part of the second example.

Next, details of the configuration will be described with reference to FIG. 3. FIG. 3 is an enlarge view of the part denoted by 31 in FIG. 2.

The drive support 22-2 has a double structure, as described above, and includes a support 22-2-1 having a threaded portion at a part in the center or over the entire support, and a fixing support 22-2-2 on the outer periphery of the support 22-2-1. An end portion 34 of the drive support 22-2-1 that is opposite to an end connected to the drive unit 21-2 has the shape of a disk or flat plate and forms an unified structure with the drive support 22-2-1, like the head of a bolt. Although FIG. 3 illustrates an example in which the end portion 34 is in the shape of a disk or flat plate, the shape of the end portion 34 is not limited to this as long as the drive support 22-2-1 has a threaded portion at a part thereof, forming a structure (stopper) that can tightly bind the cooling stage 25 with a nut 33. The cooling stage 25 has a penetration hole or slit or the like through which the drive support 22-2-1 passes and which is narrower than the stopper portion.

As the supports 22-1 and 22-2, low thermal conductivity members of FRP or the like are employed. On the cooling stage 25 side of the end portion 34, a heat transfer member 35 formed by a good conductor with a high thermal conductivity is arranged and thermally connected to the highly elastic good conductor 29. The nut 33 is arranged on the side of the cooling stage 25 that is opposite to the end portion 34 (drive unit side).

The fixing support 22-2-2 has an opening that is greater than a hypothetical circle having a diameter equal to the diagonal length of the nut 33, and has a protrusion 32 (prevention part) arranged at a position that is approximately at the height of the nut 33 so that nut 33 will not move toward the drive unit. The protrusion 32 may be a pawl-like protrusion or a constriction as long as it can prevent the nut 33 from moving toward the drive unit.

According to these configurations, as the drive unit 21-1 is made to operate, the drive support 22-2-1 rotates, narrowing the distance between the nut 33 and the support end portion 34, which in turn tightly bind the cooling stage 25. Thus, a predetermined contact pressure that is necessary for thermal connection between the heat transfer member 35 and the cooling stage 25 can be secured. In the case of separating the heat transfer member 35 and the cooling stage 25, the drive unit 21-1 can be rotated backward. In the case of securing thermal connection between the cooling stage 10 and the former 15 of the permanent current switch 3, it is possible to secure a contact pressure by the same principle as above, by causing the drive unit 21-2 to operate. Also, using the measures in this example, it is possible to secure thermal connection between the permanent current switch 3 and the refrigerator 4 without causing load concentration on the support rod 11 connecting the cooling stages 10 and 25 and the vacuum container lid 6, since the fixing support 22-2-2 is joined to the cooling stage 25. That is, efficient cooling of the permanent current switch can be realized and the structurally robust superconducting magnet device 1 can be realized.

In the above description, the supports 22-1 and 22-2 are connected to the drive units 21-1 and 21-2. However, a device that is rotationally operable from the atmospheric side (outside of the vacuum container), for example, a handle-like member to be manually operated, and the supports 22-1 and 22-2 may be connected together, instead of installing a device having a drive force. In this case, since the structure is simplified, the manufacturing cost can be restrained.

It is also possible to install only the support 22-1 and the drive unit 21-1 to connect to the cooling stage 10 for low temperature cooling. That is, the permanent current switch 3 is shifted to normal conduction, heated by the heater 16, and in the case of shifting to the permanent current mode, the cooling stage 10 and the former 15 are connected together via the heat transfer member 35, making a shift to the superconducting state. In this case, to stop the permanent current mode, the heater 16 can be made to operate to heat the permanent current switch 3, and the drive unit 21-1 can be rotated to pull the drive support 22-1 out of the nut 33. Thus, the heat transfer member 35 and the cooling stage 10 are separated from each other, enabling quick cancellation of the permanent current mode.

Also, according to such an embodiment, the drive unit 21-2 and the support 22-2 to connect the cooling stage 25 and the former 15 need not be provided, and the heat penetration paths are reduced. Therefore, the superconducting magnet device 1 operable in a more stable permanent current mode can be provided.

While the invention has been described above with reference to the drawings, the invention is not limited to the configurations described in the above embodiments and the configurations can be changed according to need, without departing from the scope of the invention described in the accompanying claims. The above embodiment examples are described in detail in order to explain the invention intelligibly. The invention is not necessarily limited to embodiment examples having all the configurations described above.

What is claimed is:

1. A superconducting magnet device comprising:

a refrigerator having a cooling stage;

a tubular former having a hollow structure;

a permanent current switch formed by a superconducting wire wound on the former;

a heater to heat the former;

a heat transfer member that has a smaller coefficient of thermal expansion than the former and that has a shape that is insertable in the former when the former is thermally expanded by the heater;

an elastic thermal conductor connecting the heat transfer member and the cooling stage; and a superconducting coil connected in parallel to the permanent current switch.

2. The superconducting magnet device according to claim 1, wherein a cross-sectional shape of the heat transfer member on a plane perpendicular to a vertical direction is equal to or smaller than the inner-diameter cross section of the former when the former is thermally expanded, and greater than the inner-diameter cross section of the former when the former is thermally contracted.

3. The superconducting magnet device according to claim 2, further comprising:

a thermal insulation support member connected to the heat transfer member; and a drive unit which is connected to the thermal insulation support member and moves the heat transfer member via the thermal insulation support member;

wherein the drive unit moves the heat transfer member in a first direction to insert the heat transfer member into the former when the former is thermally expanded by the heater, and the drive unit moves the heat transfer member in a second direction to extract the heat transfer member from the former when the former is thermally expanded by the heater.

4. The superconducting magnet device according to claim 3, wherein the cooling stage includes a high-temperature cooling stage and a low-temperature cooling stage, the heat transfer member includes a first heat transfer member and a second heat transfer member, the elastic thermal conductor includes a first elastic thermal conductor and a second elastic thermal conductor the high-temperature cooling stage is thermally connected to the first heat transfer member by the first elastic thermal conductor, the low-temperature cooling stage is thermally connected to the second heat transfer member by the second elastic thermal conductor, and the first heat transfer member and the second heat transfer member are connected to the thermal insulation support member and spaced apart from each other by a longer length than a vertical length of the former.

5. The superconducting magnet device according to claim 2, wherein the heat transfer member is fixed by a predetermined contact pressure with the former in the hollow structure of the former when the former is thermally contracted.

* * * * *